US011661271B1

(12) United States Patent
Chan

(10) Patent No.: US 11,661,271 B1
(45) Date of Patent: May 30, 2023

(54) TRASH LINER RETAINER APPARATUS

(71) Applicant: Erik Chan, Orinda, CA (US)

(72) Inventor: Erik Chan, Orinda, CA (US)

( * ) Notice: Subject to any disclaimer, the term of this patent is extended or adjusted under 35 U.S.C. 154(b) by 0 days.

(21) Appl. No.: 17/861,020

(22) Filed: Jul. 8, 2022

(51) Int. Cl.
*B65F 1/06* (2006.01)

(52) U.S. Cl.
CPC ..... *B65F 1/06* (2013.01)

(58) Field of Classification Search
CPC ..... B65F 1/06; B65F 1/1415
USPC .... 220/495.01, 495.06, 495.05, 495.11, 908, 220/908.1
See application file for complete search history.

(56) References Cited

U.S. PATENT DOCUMENTS

| | | | | |
|---|---|---|---|---|
| 4,765,579 | A | 8/1988 | Robbins et al. | |
| 5,862,932 | A | 1/1999 | Walsh et al. | |
| 5,971,194 | A * | 10/1999 | Freedland | B65F 1/06 220/495.11 |
| 6,974,029 | B2 | 12/2005 | Morand et al. | |
| 10,081,489 | B2 | 9/2018 | Morand et al. | |
| 2007/0235455 | A1 | 10/2007 | Goldberg | |

FOREIGN PATENT DOCUMENTS

| | | |
|---|---|---|
| JP | 2004091203 | 3/2004 |
| JP | 2004299841 | 10/2004 |
| JP | 4122367 | 10/2008 |
| JP | 2018002474 | 1/2018 |
| KR | 20180050055 | 5/2018 |
| WO | 2019205607 | 10/2019 |

* cited by examiner

*Primary Examiner* — John K Fristoe, Jr.
*Assistant Examiner* — Elizabeth J Volz
(74) *Attorney, Agent, or Firm* — Kanika Radhakrishnan; Evergreen Valley Law Group

(57) ABSTRACT

Embodiments of the present disclosure provide an apparatus for securing a trash liner. The apparatus includes a retainer channel disposed on at least a portion of an interior surface proximate to an aperture of a support structure. The retainer channel includes an inner surface defining an interior space within the retainer channel for receiving a mouth portion of the trash liner therein. Further, the apparatus includes a retainer member. The retainer member includes one or more flange members. Each flange member of the one or more flange members extends from a bottom portion of the retainer member and is oriented along a longitudinal axis of the support structure. The retainer member is configured to removably secure to the retainer channel for retaining the mouth portion of the trash liner therebetween, while an unsecured portion of the trash liner is disposed within the support structure.

23 Claims, 13 Drawing Sheets

TRASH LINER RETAINER APPARATUS

TECHNICAL FIELD

The present disclosure relates to trash liner retainers, and more particularly relates, to an apparatus for retaining a mouth portion of a trash liner disposed in a trash receptacle.

BACKGROUND

Trash receptacles are used for collecting waste matter (e.g., kitchen refuse). Plastic films formed into a trash bag are inserted into the trash receptacle for collecting refuse. Usually, the opening of the trash bag is merely folded over an aperture of the trash receptacle to prevent the disruption of the trash bag containing the refuse material. However, in some scenarios, if the opening of the trash bag is oversized compared to the trash receptacle aperture, the opening of the trash bag has to be tied with a knot for snuggly fitting the trash bag over the trash receptacle aperture. Further, rendering the opening of the trash bag exposed and/or flopping loosely on the trash receptacle creates a messy and unattractive appearance which is undesirable as the primary purpose of a trash receptacle is to store waste in a clean and organized manner.

Many of the trash bags, currently in use, are merely folded over the opening of the trash receptacle. Such arrangement causes the trash bags to collapse either partially or completely into the trash receptacle, causing interference in disposing of the refuse in the trash bags. Moreover, in such scenarios, a portion of the trash bag may get in contact with the refuse (e.g., liquid waste). As a result, the trash bag and the trash receptacle become unsanitary and require cleaning of the trash receptacle. Due to the unsanitary condition of the trash bag, an individual may get in contact with harmful microorganisms while disposing of the trash bag. Additionally, the trash bag may be susceptible to breakage or tearing due to the stretching of the trash bag while securing the trash bag over the trash receptacle opening.

Therefore, there is a need for an apparatus for securing the opening of the trash bag to overcome one or more limitations stated above in addition to providing other technical advantages.

SUMMARY

Various embodiments of the present disclosure provide trash liner retainer apparatus.

In an embodiment, an apparatus for securing a trash liner is disclosed. The apparatus includes a retainer channel disposed on at least a portion of an interior surface proximate to an aperture of a support structure. The retainer channel includes an inner surface defining an interior space within the retainer channel for receiving a mouth portion of the trash liner therein. The apparatus further includes a retainer member. The retainer member includes one or more flange members. Each flange member of the one or more flange members extends from a bottom portion of the retainer member and is oriented along a longitudinal axis of the support structure. The retainer member is configured to removably secure to the retainer channel for retaining the mouth portion of the trash liner therebetween, while an unsecured portion of the trash liner is disposed within the support structure.

In another embodiment, an apparatus for securing a mouth portion of a trash liner is disclosed. The apparatus includes a retainer channel disposed on at least a portion of an interior surface proximate to an aperture of a support structure. The retainer channel includes an inner surface defining an interior space within the retainer channel for receiving a mouth portion of the trash liner therein. The apparatus further includes a pair of flexible retainer members. The pair of flexible retainer members includes a first flexible retainer member and a second flexible retainer member. The first and second flexible retainer members are mounted to the inner surface of each sidewall of a pair of sidewalls of the retainer channel such that a portion of the first and second flexible retainer members is oriented parallel or near parallel to a base surface of the retainer channel. Further, a free end of the first and second flexible retainer members is facing toward each other and positioned in close proximity, thus defining a gap therebetween. Furthermore, the first and second flexible retainer members are operated between a collapsed form and a retracted form for retaining the mouth portion of the trash liner within the interior space of the retainer channel.

In yet another embodiment, an apparatus for securing a mouth portion of a trash liner is disclosed. The apparatus includes a retainer channel disposed on at least a portion of an interior surface proximate to an aperture of a support structure. The retainer channel includes an inner surface defining an interior space within the retainer channel for receiving the mouth portion of the trash liner therein. The apparatus further includes a retainer member. The retainer includes one or more flange members. Each flange member of the one or more flange members extends from a bottom portion of the retainer member and is oriented along a longitudinal axis of the support structure. The retainer member is configured based on a geometric design of the retainer channel for enabling a snug fit between the retainer member and the retainer channel. Further, the retainer member is configured to removably secure to the retainer channel for retaining the mouth portion of the trash liner therebetween, while an unsecured portion of the trash liner is disposed within the support structure. Furthermore, one or more flange members of the retainer member abuts the inner surface of the retainer channel for removably securing the retainer member to a top portion of the retainer channel.

BRIEF DESCRIPTION OF THE FIGURES

The following detailed description of illustrative embodiments is better understood when read in conjunction with the appended drawings. For the purpose of illustrating the present disclosure, exemplary constructions of the disclosure are shown in the drawings. However, the present disclosure is not limited to a specific device, or a tool and instrumentalities disclosed herein. Moreover, those in the art will understand that the drawings are not to scale.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearances of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Various example embodiments of the present disclosure are described hereinafter with reference to FIGS. 1A-lE to FIG. 6.

Figure 1A:
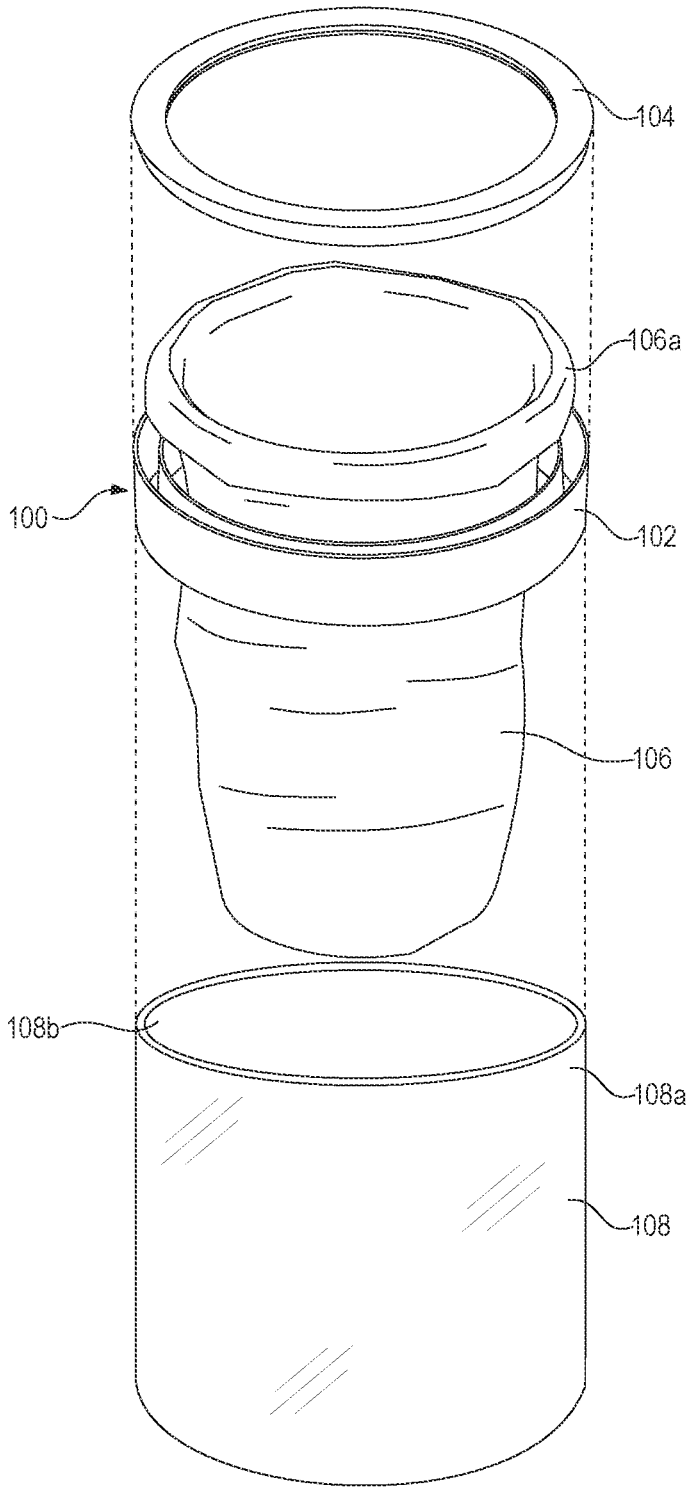
FIG. 1A illustrates an exploded view of an apparatus for retaining a mouth portion of a trash liner, in accordance with an embodiment of the present disclosure.

FIG. 1A illustrates an exploded view of an apparatus 100 for retaining a trash liner 106, in accordance with an embodiment of the present disclosure. The apparatus 100 includes a retainer channel 102 and a retainer member 104. The apparatus 100 including the retainer channel 102 and the retainer member 104 is configured to retain a mouth portion 106*a* of the trash liner 106.

The trash liner 106, made from plastic films, paper or other flexible sheet material, can be disposed (e.g., mounted, placed, positioned, secured, etc.) within a support structure 108 for collecting waste matter (or refuse). For example, the support structure 108 may be a trash receptacle. Typically, the mouth portion 106*a* referenced for the open edge or an opening of the trash liner 106 is secured in the retainer channel 102 by removably engaging the retainer member 104. More specifically, the retainer channel 102 is substantially disposed at a top portion 108*a* of the support structure 108 (hereinafter interchangeably referred to as 'the trash receptacle 108'). Moreover, the retainer channel 102 is dimensioned corresponding to the dimensions of the top portion 108*a* of the trash receptacle 108 for snuggly fitting the retainer channel 102 to the trash receptacle 108. The mouth portion 106*a* of the trash liner 106 is stuffed in the retainer channel 102. Thereafter, the retainer member 104 is removably secured to the retainer channel 102 for retaining the mouth portion 106*a* of the trash liner 106 therein, while the remaining portion of the trash liner 106 is disposed within the trash receptacle 108. As a result, the trash liner 106 disposed in the trash receptacle 108 eliminates manual intervention involved in cleaning the trash receptacle 108. Additionally, usage of the trash liner 106 in the trash receptacle 108 ensures the hygiene of the trash receptacle 108, and hence a user and/or an individual is able to safely dispose of the trash liner 106.

Figure 1B:
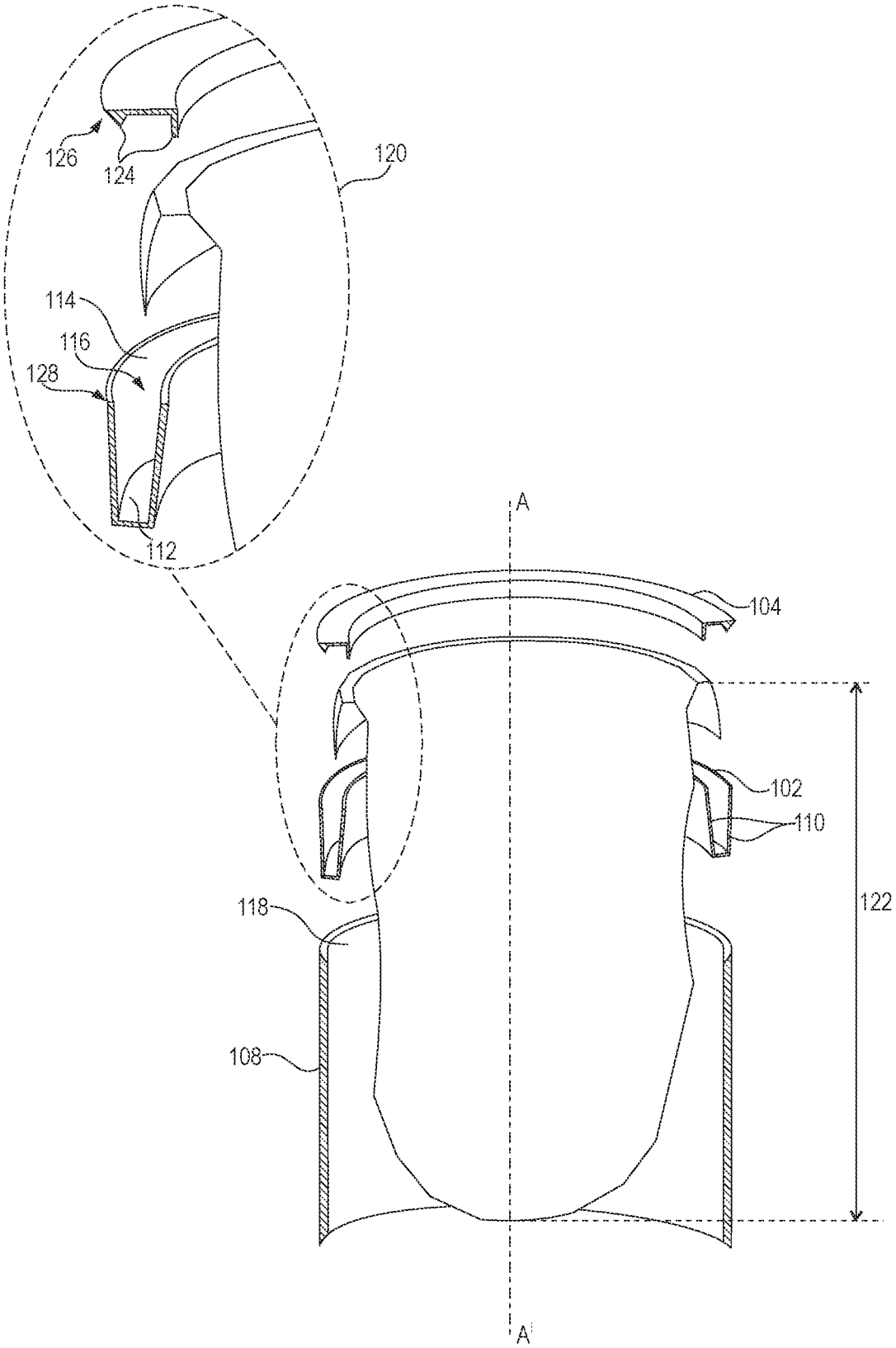
FIG. 1B illustrates a sectional view of the apparatus of FIG. 1A and an enlarged portion thereof depicting a portion of a retainer channel, a retainer member, and the trash liner, in accordance with an embodiment of the present disclosure.

Referring to FIG. 1B, is a sectional view of the apparatus 100, in accordance with an embodiment of the present disclosure. As shown, the retainer channel 102 is configured with a U-shaped structure. It will be apparent that the U-shaped structure of the retainer channel 102 includes a pair of sidewalls 110 and a base surface 112. As such, each sidewall 110 extends from opposite sides of the base surface 112 along its length. It is to be noted that the sidewalls 110 of the retainer channel 102 align roughly parallel to a longitudinal axis A-A'. The longitudinal axis A-A' corresponds to a vertical axis of the trash receptacle 108. Further, the retainer channel 102 includes an inner surface 114 (see, an enlarged portion 120 of FIG. 1B) defining an interior space 116 (see, the enlarged portion 120) within the retainer channel 102. In other words, the area bounded by the sidewalls 110 and the base surface 112 refers to the interior space 116 of the retainer channel 102.

In an embodiment, the sidewalls 110 may be detachably coupled to the opposite ends of the base surface 112 via conventional mounting means for forming a U-shaped structure of the retainer channel 102. For example, the base surface 112 and the sidewalls 110 may be configured with the snap-fit arrangement for allowing detachable mounting of the sidewalls 110 to the base surface 112. Alternatively, the sidewalls 110 may be mounted to the base surface 112 using glue or any other fastening means as per the design feasibility and requirement. In another embodiment, the retainer channel 102 may be configured with a V-shaped structure or any other structural configuration as per design feasibility and requirement.

The retainer channel 102 including the interior space 116 is configured to receive the mouth portion 106*a* of the trash liner 106 therein. More specifically, the retainer channel 102 is disposed on at least a portion of an interior surface 118 proximate to an aperture (see, 108*b* of FIG. 1A) of the trash receptacle 108. As explained above, the retainer channel 102 is dimensioned in conformity with the dimensions of the interior surface 118 of the trash receptacle 108 to ensure a snug fit between the retainer channel 102 and the trash receptacle 108. In other words, the trash receptacle 108 may be configured with thickness. To that effect, the retainer channel 102 is configured based on an inner perimeter of the aperture 108*b*, thereby allowing a snug fit between the retainer channel 102 and the trash receptacle 108.

The retainer channel 102 may be made of flexible materials such as, but not limited to, high-density polythene, thermoplastic, polycarbonate sheets, and the like. It is to be noted that the retainer channel 102 configured with the flexible materials should possess adequate breakage strength for allowing elastic deformation of the retainer channel 102 during use. Thus, the retainer channel 102 may be distorted while securing the retainer channel 102 to the trash receptacle 108. It will be apparent that the retainer channel 102 assumes its original state upon releasing pressure on the retainer channel 102, thus ensuring a snug fit between the retainer channel 102 and the trash receptacle 108.

In an embodiment, the retainer channel 102 may be secured to the interior surface 118 proximate to the aperture 108*b* of the trash receptacle 108 using conventional mounting means such as, but not limited to, bonding, gluing as per feasibility and requirement. In another embodiment, the retainer channel 102 may be an integral part of the trash receptacle 108.

Figure 1C:
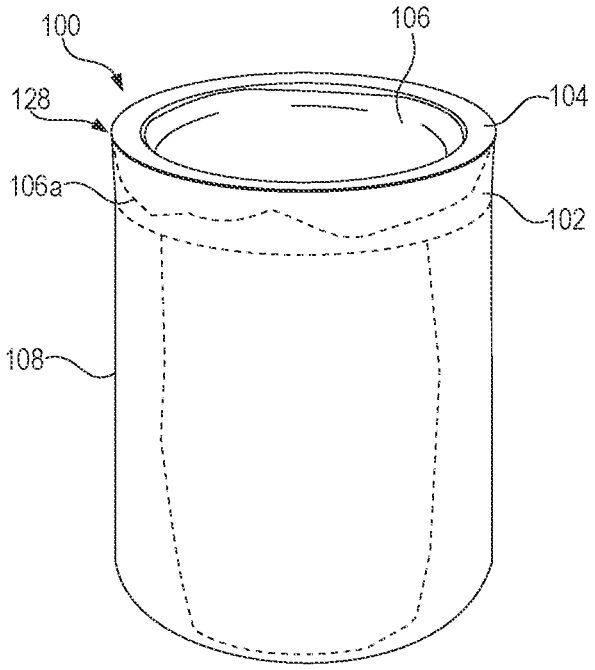
FIG. 1C is a schematic representation of the apparatus of FIG. 1A disposed within a support structure, in accordance with an embodiment of the present disclosure.

In use, the mouth portion 106*a* of the trash liner 106 is received in the interior space 116 of the retainer channel 102. More specifically, the mouth portion 106*a* is folded over the sidewalls 110 and inserted into the interior space 116. Thereafter, the retainer member 104 is removably secured to the retainer channel 102 for retaining the mouth portion 106*a* within the interior space 116, while an unsecured portion 122 of the trash liner 106 is disposed within the trash receptacle 108 (as shown in FIG. 1C). The unsecured portion 122 corresponds to a portion of the trash liner 106 extending from the retainer channel 102 upon removably engaging the retainer member 104 with the retainer channel 102.

Further, the retainer member 104 includes one or more flange members 124 (see, the enlarged portion 120). Each flange member of the one or more flange members 124 extends from a bottom portion 126 of the retainer member 104 and is oriented along the longitudinal axis A-A'. In other words, the flange member(s) 124 extend from opposite ends of the bottom portion 126 of the retainer members (see, the enlarged portion 120). In an embodiment, the length dimension of one of the flange members may be greater than the other flange member (as shown in FIG. 1B). Alternatively, the flange members 124 may be configured with a similar length dimension or any other configuration as per design feasibility and requirement.

In one implementation, the flange members 124 configured at the bottom portion 126 may extend along the length of the retainer member 104 (as shown in FIGS. 1A and 1B), thus forming a unified structure of the retainer member 104. In another implementation, the flange members 124 may be detachably mounted at the bottom portion 126 via conventional fastening means to form the retainer member 104. In another implementation, the flange members 124 may be configured at regular intervals at the bottom portion 126 along its length (not shown in figures).

Further, the retainer member 104 may be made of flexible materials similar to the retainer channel 102. Thus, the retainer member 104 may exhibit similar mechanical properties as that of the retainer channel 102. Particularly, the retainer member 104 including the flange members 124 abuts the inner surface 114 of the retainer channel 102 while removably securing the retainer member 104 to a top portion 128 of the retainer channel 102. Moreover, the retainer member 104 is configured based on a geometric design of the retainer channel 102, thereby enabling a snug fit between the retainer member 104 and the retainer channel 102. For example, the geometric design of the retainer channel 102 is selected to be one of a circular/oval shape (as shown in FIGS. 1A and 1C). The geometric design of the retainer channel 102 and the retainer member 104 is configured corresponding to the shape of the aperture 108*b* and/or the geometric design of the top portion 108*a* of the trash receptacle 108. This configuration of the apparatus 100 enables the snug fit between the retainer channel 102 and the trash receptacle 108. In some embodiments, the structural configuration of the retainer channel 102, the retainer member 104, and the support structure 108 may be configured in various geometric designs such as, but not limited to, oval, square, hexagon, pentagon, rectangular, rectangular with rounded corners, or any other geometric or organic shapes, which serve the purposes.

Moreover, the retainer member 104 snuggly fits onto the top portion 128 of the retainer channel 102 due to a similar geometric design (as shown in FIG. 1C). In an embodiment, the retainer member 104 may be removably secured to the top portion 128 of the retainer channel 102 via conventional fastening means such as a snap-fit arrangement, or the like. As such, removably securing the retainer member 104 onto the top portion 128 of the retainer channel 102 conceals the mouth portion 106*a* therein (as shown in FIG. 1C). Further, the mouth portion 106*a* retained within the interior space 116 eliminates the loose flopping of the mouth portion 106*a* and enhances the aesthetic appeal. Furthermore, the retainer member 104 is detached from the retainer channel 102 for disposal when the trash liner 106 is completely filled with refuse.

In one embodiment, the support structure 108 (or the trash receptacle 108) may be configured with a freeform shape (i.e. irregular or asymmetrical design). In this case, the retainer channel 102 may be configured to align with the perimeter (either interior or exterior perimeter) of the support structure 108 due to its elastic property, thereby securing the retainer channel 102 to the trash receptacle 108.

Figure 1D:
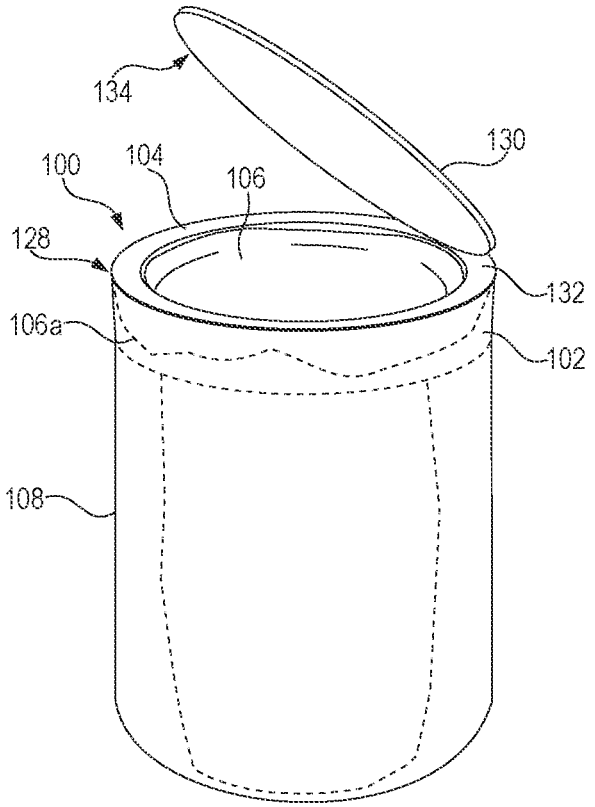
FIGS. 1D and 1E, illustrate a schematic representation of the apparatus of FIG. 1A, depicting a lid of the retainer member operable between an open position and a closed position, in accordance with an embodiment of the present disclosure.
Figure 1E:
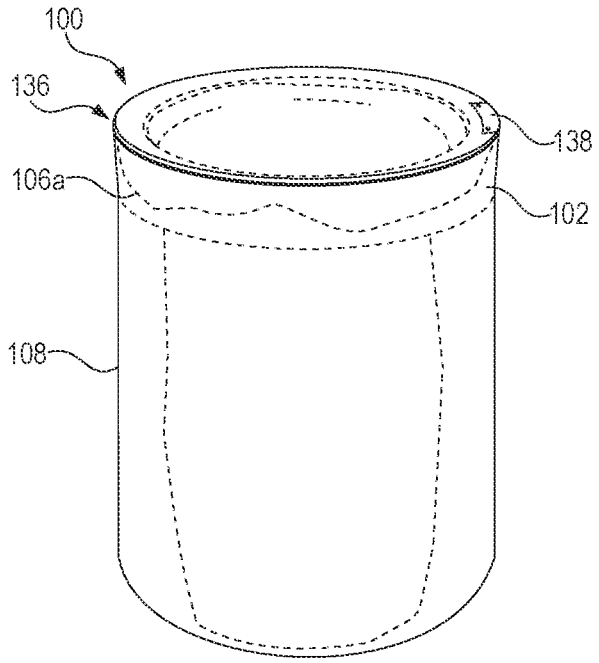

In an embodiment, the retainer member 104 may be configured with a lid 130. The lid 130 may be secured to one end of a top portion 132 of the retainer member 104 (as shown in FIG. 1D). The lid 130 may be secured to the retainer member 104 via a hinge mechanism (see, 138 of FIG. 1E). In an embodiment, the lid 130 may be secured to the retainer member 104 using any other conventional means. The lid 130 may be made of flexible materials as explained above. The lid 130 may be operated in an open position (see, 134), prior to securing the mouth portion 106*a* of the trash liner 106 (as shown in FIG. 1D). Further, the lid 130 may be operated to a closed position (see, 136) upon securing the retainer member 104 atop the supporting structure 108 (as shown in FIG. 1E). It is to be noted that the lid 130 operated in the closed position 136 helps in maintaining the hygiene of the surrounding environment while the trash is being stored in the trash liner 106 disposed in the trash receptacle 108.

Figure 2A:
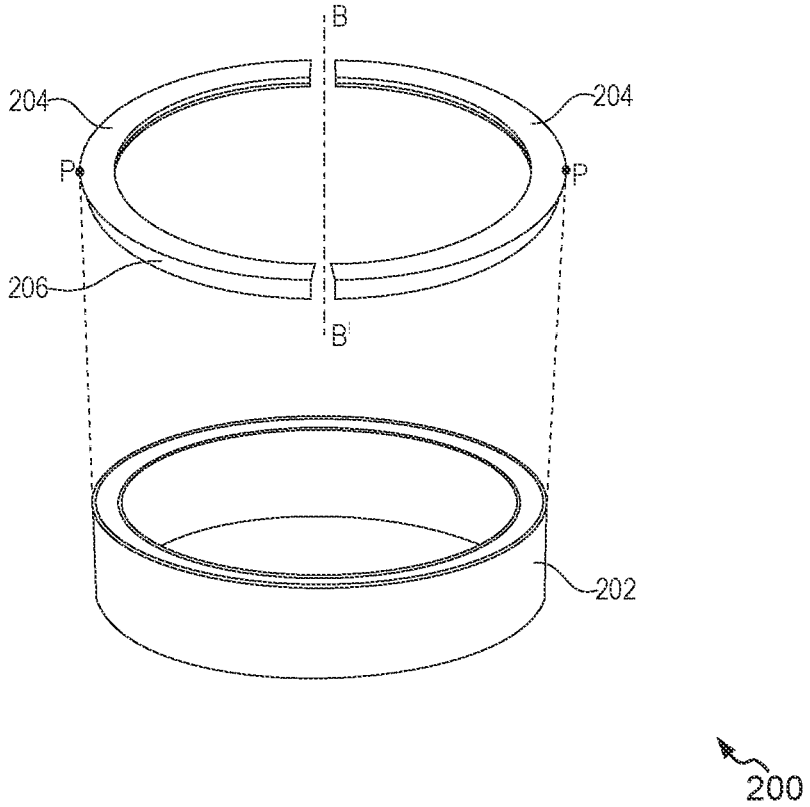
FIG. 2A is a schematic representation of an apparatus for securing the mouth portion of the trash liner, in accordance with an embodiment of the present disclosure.
Figure 2B:
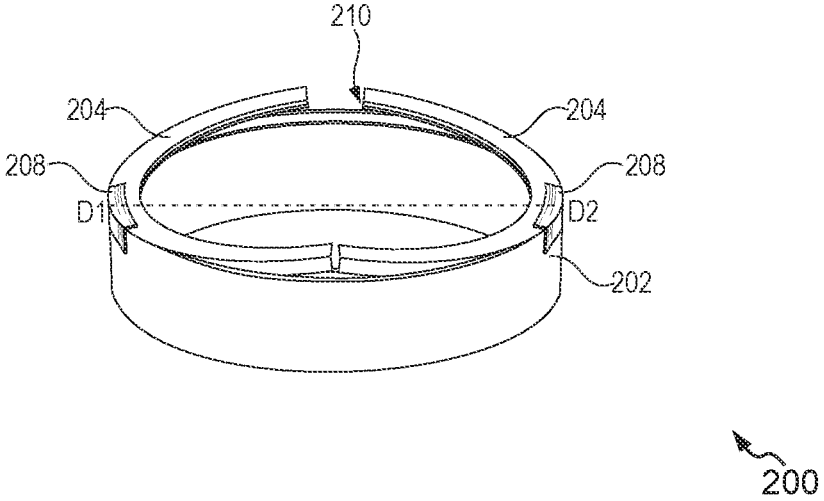
FIG. 2B is a schematic representation of the apparatus of FIG. 2A operated in an open position for receiving the mouth portion of the trash liner, in accordance with an embodiment of the present disclosure.

Referring to FIG. 2A, the apparatus 200 includes a retainer channel 202 and a retainer member 204. The configuration of the retainer channel 202 is similar to the configuration of the retainer channel 102 of FIG. 1A, and therefore it is not explained in detail for the sake of brevity. As shown in FIG. 2A, the retainer member 204 configured in the geometric design of a circular shape may be partitioned along an axis B-B' into two semi-circular segments (or two symmetrical segments). In this configuration, each segment of the retainer member 204 may be hingedly coupled to the retainer channel 202. More specifically, a point P on each semi-circular segment of the retainer member 204 defines the one line of symmetry (or reflection symmetry) of the semi-circular segment of the retainer member 204. Thus, point P may be considered the mounting point of the semi-circular segment of the retainer member 204. The retainer member 204 may be temporarily mounted to the retainer channel 202 at the point P via a hinge mechanism (see, 208 of FIG. 2B). Particularly, the point P of each semi-circular segment of the retainer member 204 may be secured with one part of the hinge mechanism 208. Further, the point P of each of the semi-circular segments of the retainer member 204 is positioned at diametrically opposite ends (represented as D1 and D2) of the retainer channel 202. Thereafter, each semi-circular segment of the retainer member 204 is secured to the retainer channel 202 via the hinge mechanism 208 (as shown in FIG. 2B). The retainer member 204 hingedly coupled to the retainer channel 202 is operable between an open position (see, 210 of FIG. 2B) and a closed position (see, 212 of FIG. 2C).

Figure 2C:
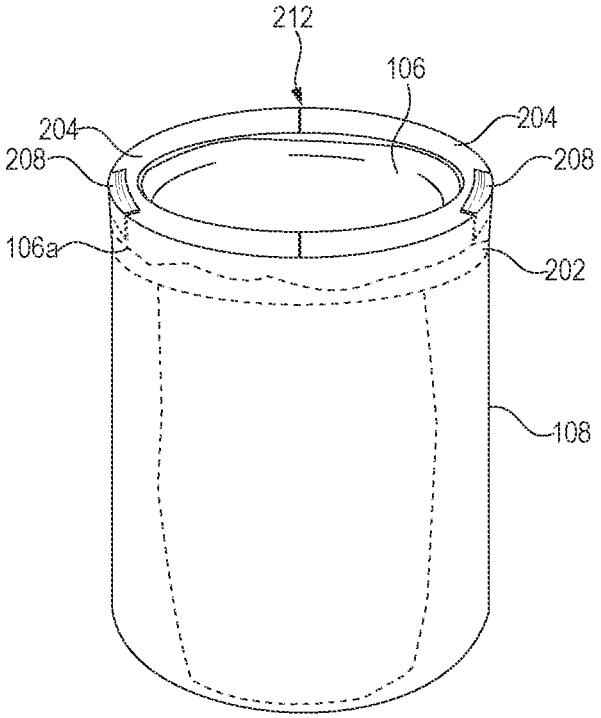
FIG. 2C is a schematic representation of the apparatus of FIG. 2A operated in a closed position for retaining the mouth portion of the trash liner, in accordance with an embodiment of the present disclosure.

In use, the retainer channel 202 hingedly coupled to the retainer member 204 may be disposed in the trash receptacle 108. The hinge mechanism 208 may include flex hinges of negligible thickness. Thus, the hinge mechanism 208 prevents hindrance to the apparatus 200 while securing the apparatus 200 to the trash receptacle 108. In other words, the hinge mechanism 208 adapts suitably for securing the retainer channel 202 to the trash receptacle 108. It is to be noted that the functionality of the hinge mechanism 208 is not affected, upon securing the retainer channel 202 to the trash receptacle 108. Further, the retainer member 204 (both the semi-circular segments) is operated in the open position 210 for allowing insertion of the mouth portion 106*a* of the trash liner 106 within the retainer channel 202. It is to be noted that the hinge mechanism 208 (e.g., the flex hinges) provides a sufficient degree of movement for operating the retainer member 204 in the open position 210 in order to allow insertion of the mouth portion 106*a* of the trash liner 106 within the retainer channel 202. Further, upon securing the mouth portion 106*a* within the retainer channel 202, the retainer member 204 is operated in the closed position 212 (as shown in FIG. 2C). More specifically, the retainer member 204 includes one or more flange members (see, 206 of FIG. 2A) of the retainer member 204 similar to the retainer member 104. The flange members 206 abuts the inner surface of the retainer channel 202 while securing the retainer member 204 to the retainer channel 202 (or operated in the closed position 212).

Figure 3A:
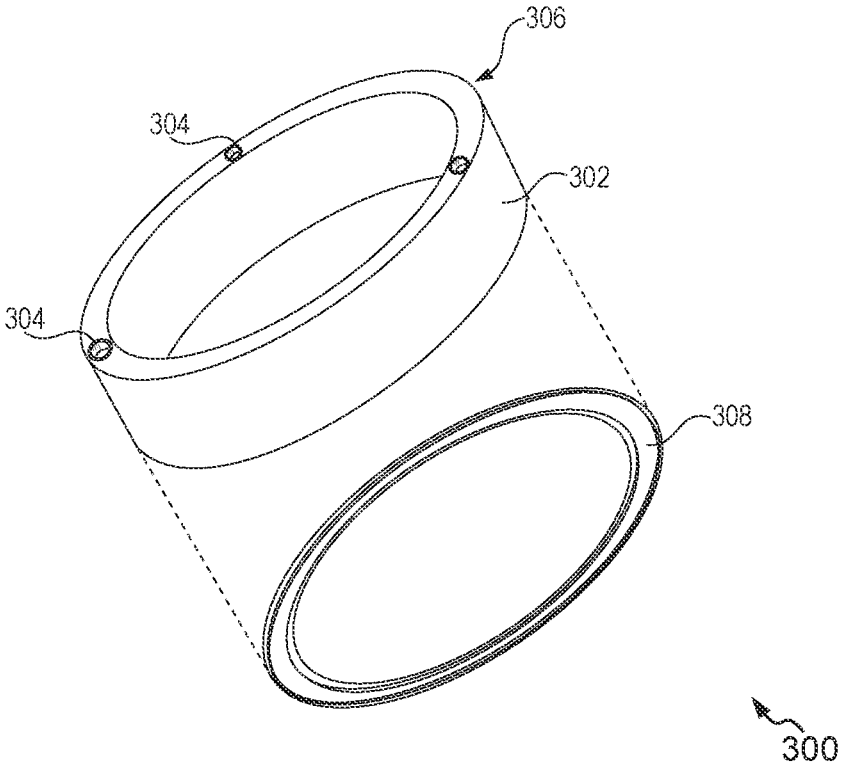
FIG. 3A illustrates an exploded bottom perspective view of an apparatus for securing the mouth portion of the trash liner, in accordance with an embodiment of the present disclosure.

FIG. 3A illustrates an exploded bottom perspective of an apparatus 300 for securing the mouth portion 106*a* of the trash liner 106, in accordance with an embodiment of the present disclosure. The apparatus 300 includes a retainer channel 302 and a retainer member 308. The retainer channel 302 and the retainer member 308 are similar to the retainer channel 102 and the retainer member 104, respectively. As shown, the retainer channel 302 is configured with a plurality of slots 304 (exemplarily depicted to be three slots) at regular intervals at a bottom portion 306 of the retainer channel 302. The slots 304 allow insertion of one ends 310*a* of a plurality of elongated tubular structures 310. The dimensions of the elongated tubular structures 310 are configured in conformity with the dimensions of the slots 304 for allowing a snug fit of the elongated tubular structures 310 within the slots 304. In an embodiment, the bottom portion 306 of the retainer channel 302 may be permanently affixed with the elongated tubular structures 310. It is to be noted that the number of the elongated tubular structures 310 is dependent on the number of slots 304 configured at the bottom portion 306 of the retainer channel 302.

Figure 3B:
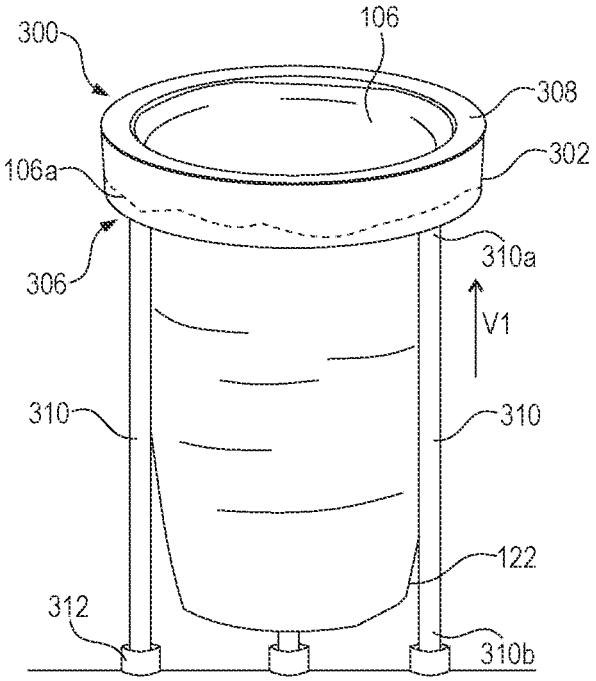
FIG. 3B is a schematic representation of the apparatus of FIG. 3A securing the mouth portion of the trash liner being supported on elongated tubular structures, in accordance with an embodiment of the present disclosure.

Upon securing the elongated tubular structures 310 within the slots 304, the elongated tubular structures 310 are oriented along a vertical direction 'V1' for supporting the retainer channel 302 above the ground (as shown in FIG. 3B). In other words, the apparatus 300 securing the mouth portion 106*a* of the trash liner 106 is raised off a supporting surface (such as a floor) by the elongated tubular structures 310 (as shown in FIG. 3B). Additionally, the elongated tubular structures 310 may include supporting bushes 312 secured to another ends 310*b* of the elongated tubular structures 310. The supporting bush 312 ensures stability when the apparatus 300 supported on the elongated tubular structures 310 is raised off the supporting surface.

Further, the mouth portion 106*a* of the trash liner 106 is secured in the retainer channel 302 by securing the retainer member 308 on top of the retainer channel 302 (as shown in FIG. 3B). As shown in FIG. 3B, the unsecured portion 122 of the trash liner 106 is allowed to flex in a space between the plurality of elongated tubular structures 310 supporting the retainer channel 302. It will be apparent that the retainer channel 302 can also be supported on the floor with only two elongated tubular structures 310 secured to the appropriate slots 304 which allows balancing of the apparatus 300 when the elongated tubular structures 310 are oriented along the vertical direction 'V1'. In an embodiment, the retainer channel 302 mounted with the elongated tubular structures 310 may be secured within a trash receptacle (such as the trash receptacle 108).

Figure 4A:
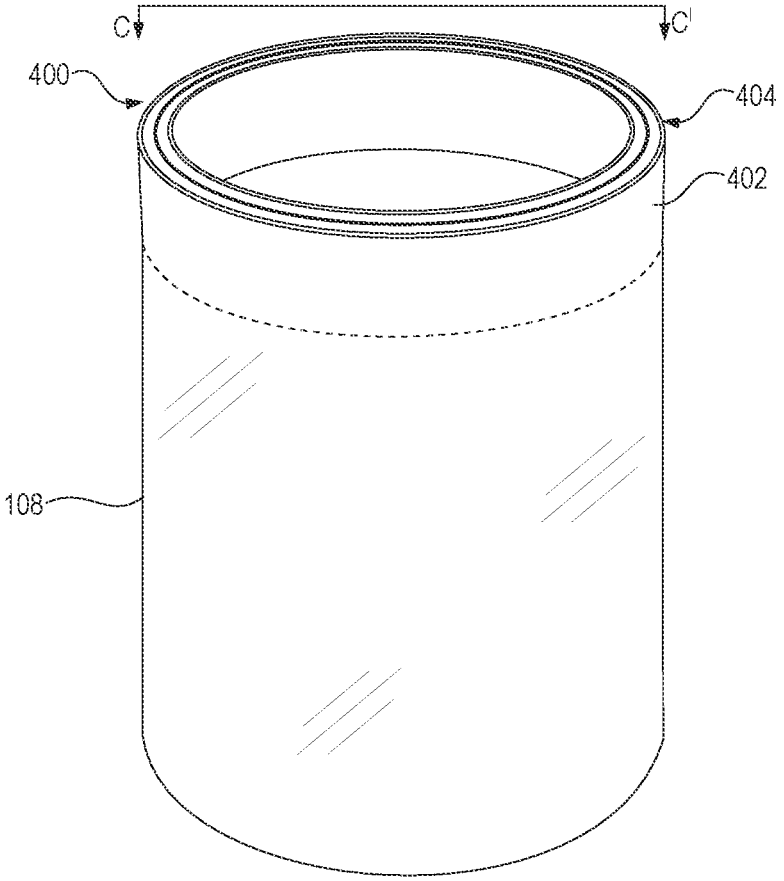
FIG. 4A illustrates a perspective of an apparatus for securing the mouth portion of the trash liner, in accordance with an embodiment of the present disclosure.

Referring to FIG. 4A, an apparatus 400 includes a retainer channel 402 adapted to be secured within a trash receptacle (such as the trash receptacle 108). The retainer channel 402 secured within the trash receptacle 108 is configured to secure the mouth portion 106*a* of the trash liner 106.

Figure 4B:
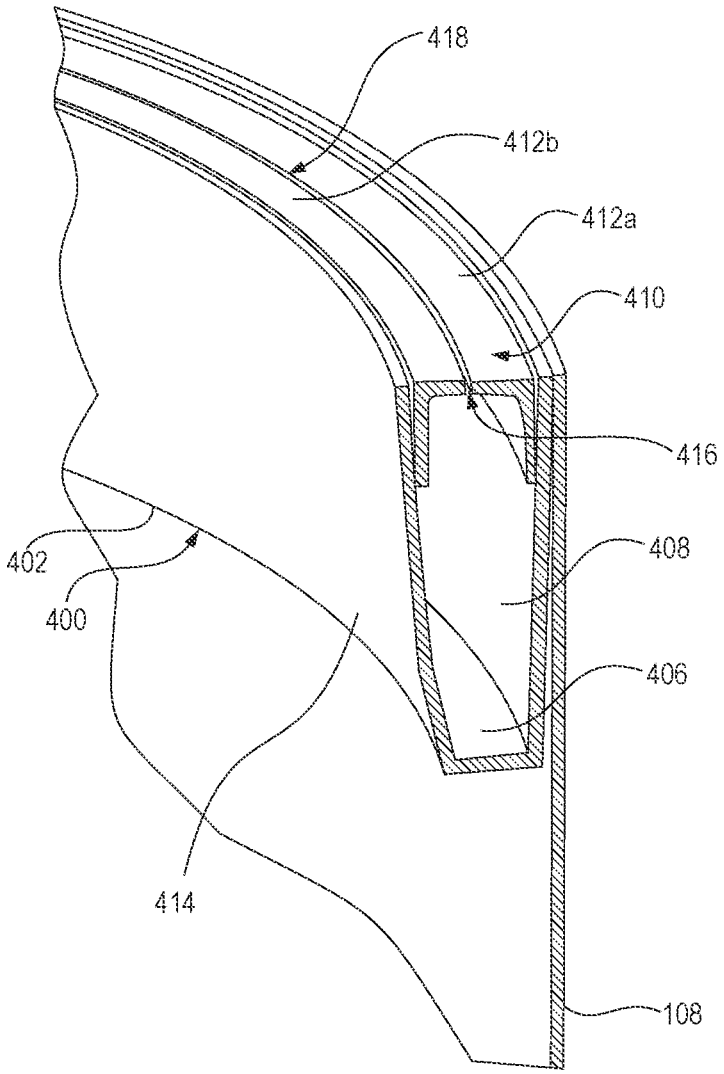
FIG. 4B is a sectional view of a portion of the apparatus of FIG. 4A, depicting a pair of flexible retainer members of the apparatus, in accordance with an embodiment of the present disclosure.

Referring to FIG. 4B, a sectional view of a portion of the retainer channel 402 along an axis C-C' of the apparatus 400 is illustrated, in accordance with an embodiment of the present disclosure. The configuration of the retainer channel 402 is similar to the retainer channel 102 of FIG. 1A. As shown, the retainer channel 402 is configured with a U-shaped structure. It will be apparent that the U-shaped structure of the retainer channel 402 includes a pair of sidewalls 414 and a base surface 406 of the retainer channel 402. As such, each of the sidewalls 414 extends from opposite sides of the base surface 406 along its length.

Additionally, the apparatus 400 includes a pair of flexible retainer members 410. The pair of flexible retainer members 410 includes a first flexible retainer member 412*a*, and a second flexible retainer member 412*b*. The first and second flexible retainer members 412*a*, and 412*b* are mounted to an inner surface 408 of each sidewall 414 of the retainer channel 402 and located at a top portion 404 of the retainer channel 402. The first and second flexible retainer members 412*a*, and 412*b* are mounted to the inner surface 408 of each sidewall 414 such that a portion of the first and second flexible retainer members 412*a*, 412*b* configured for securing the trash liner 106 is oriented parallel to the base surface 406 of the retainer channel 402 (as shown in FIG. 4B). Examples of the flexible materials used in the first and second flexible retainer members 412*a*, and 412*b* may be rubber or flexible plastic, or the like. In an embodiment, the first and second flexible retainer members 412*a*, and 412*b* may be detachably mounted to the retainer channel 402 via conventional mounting means such as bonding, gluing, or any other mounting means as per design feasibility and requirement. In another embodiment, the retainer channel 402 may be configured with a groove or channel (not shown in figures) in the sidewalls 414. Further, the first and second flexible retainer members 412*a*, and 412*b* may be configured with suitable securing means based on the dimensions of the groove configured in the sidewalls 414 for enabling mounting of the first and second flexible retainer members 412*a*, and 412*b* to the retainer channel 402.

Further, a free end 416 of the first and second flexible retainer members 412*a*, and 412*b* is facing toward each other and located in close proximity and defines a gap 418 i.e. a narrow channel therebetween (as shown in FIG. 4B). As shown in FIG. 4B, the first and second flexible retainer members 412*a*, and 412*b* mounted to the inner surface 408 and oriented parallel to the base surface 406 are positioned at the same height in the retainer channel 402. In an embodiment, the first flexible retainer member 412*a* may be positioned at a height slightly less than the height of the second flexible retainer member 412*b* or vice-versa.

Figure 4C:
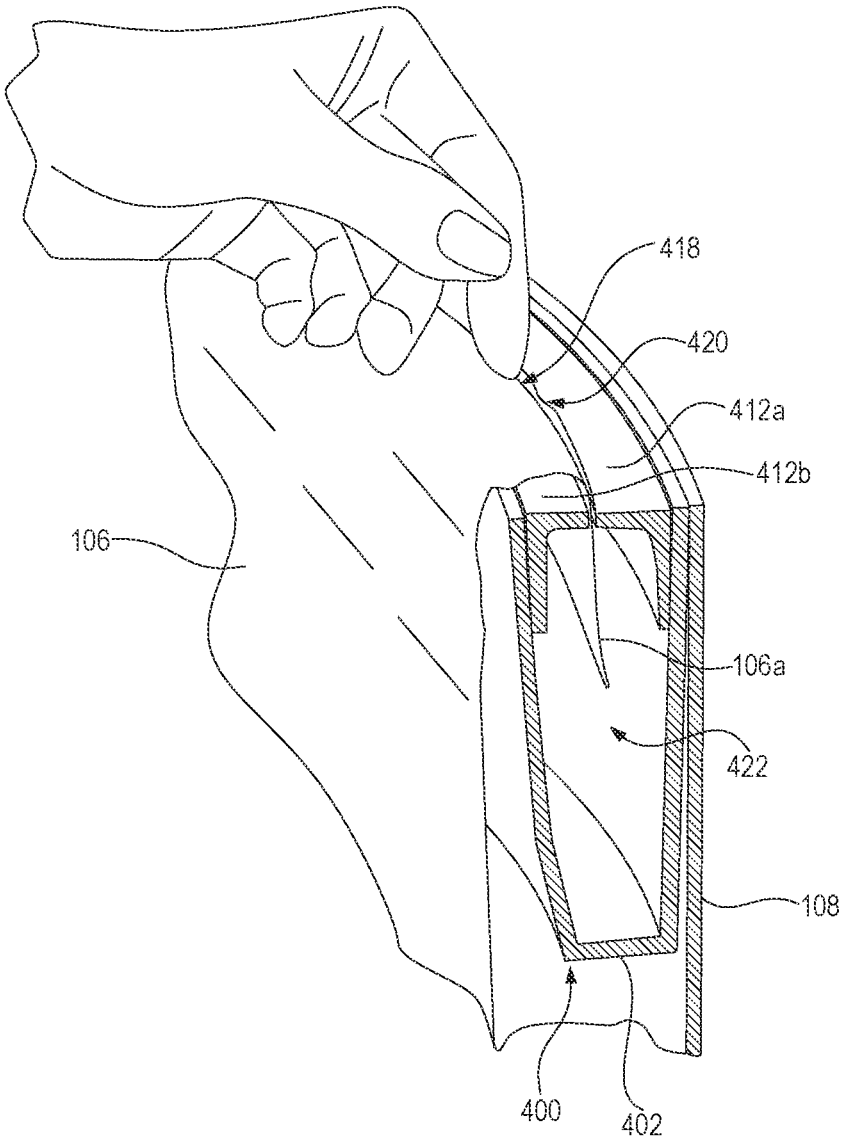
FIGS. 4C and 4D illustrate a stepwise articulation of the pair of flexible retainer members for retaining the mouth portion of the trash liner within a retainer channel of the apparatus, in accordance with an embodiment of the present disclosure.
Figure 4D:
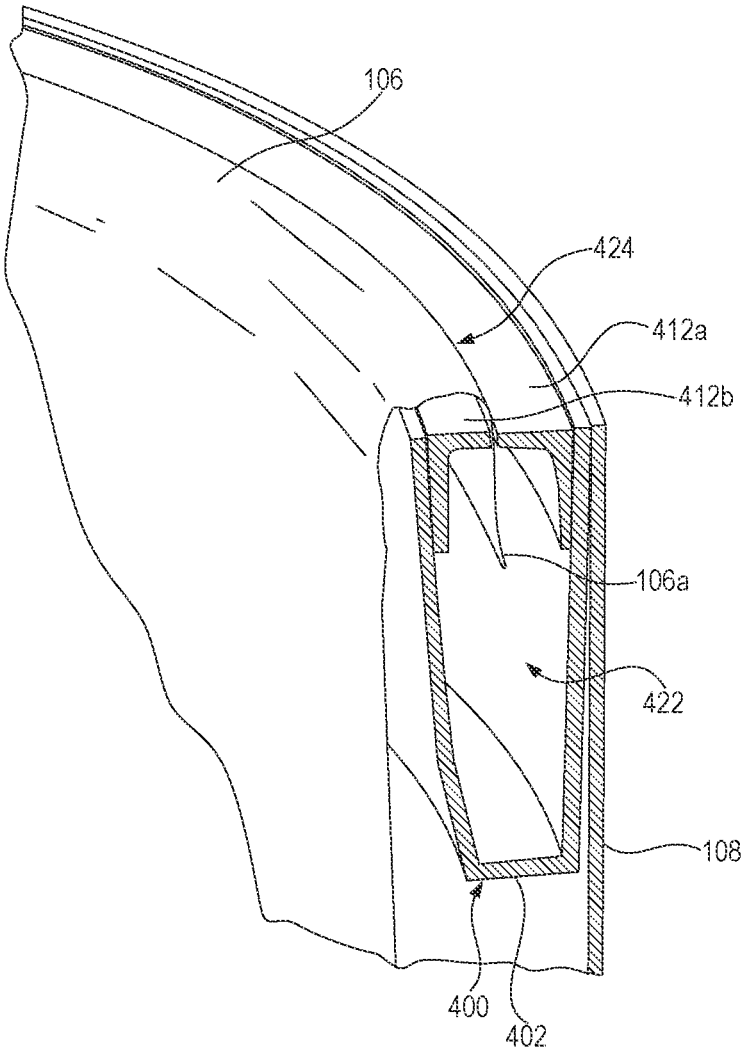

In use, at least one of the first and second flexible retainer members 412*a*, and 412*b* is operated in a collapsed form (see, 420 of FIG. 4C). For illustration purposes, a user's hand operating at least one of the first and second flexible retainer members 412*a*, and 412*b* is shown in FIG. 4C. Moreover, operating either of the first and second flexible retainer members 412*a*, and 412*b* in the collapsed form 420 alters the gap 418, thereby allowing insertion of the mouth portion 106*a* of the trash liner 106 within an interior space 422 of the retainer channel 402 (as shown in FIG. 4C). In other words, operating at least one of the first and second flexible retainer members 412*a*, and 412*b* in the collapsed form 420 widens the gap 418, thus allowing the user to insert the mouth portion 106*a* of the trash liner 106 within the interior space 422 defined in the retainer channel 402 (as shown in FIG. 4C). Thereafter, the user may release the pressure on the first and second flexible retainer members 412*a*, and 412*b* for securing the mouth portion 106*a* of the trash liner 106 in the interior space 422 of the retainer channel 402 (as shown in FIG. 4D). More specifically, the first and second flexible retainer members 412*a*, and 412*b* attain a retracted form 424 from the collapsed form 420 upon releasing the pressure from the first and second flexible retainer members 412*a*, and 412*b* (as shown in FIG. 4D). The first and second flexible retainer members 412*a*, and 412*b* operated in the retracted form 424 from the collapsed form 420 retains the mouth portion 106*a* of the trash liner 106 in the interior space 422 of the retainer channel 402 (as shown in FIG. 4D). This configuration of the apparatus 400 eliminates the usage of the retainer member as explained with references to FIGS. 1A-3B for securing the trash liner 106.

Figure 4E:
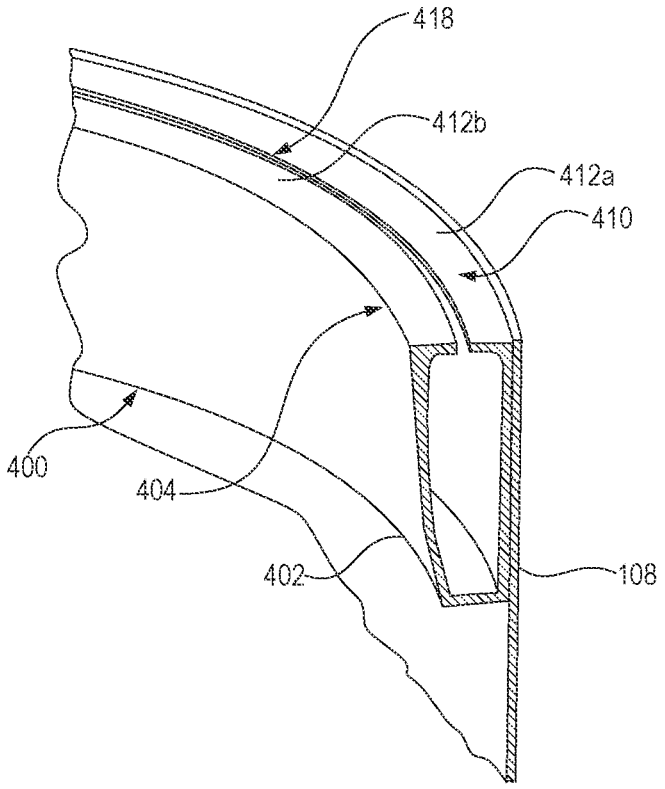
FIG. 4E illustrates a sectional view of a portion of the apparatus of FIG. 4A for retaining the mouth portion of the trash liner, in accordance with another embodiment of the present disclosure.

In an embodiment, the first and second flexible retainer members 412*a*, and 412*b* may be the integral components of the retainer channel 402 (as shown in FIG. 4E). In other words, the U-shaped structure of the retainer channel 402 may be configured with the first and second flexible retainer members 412*a*, and 412*b* at the top portion 404 of the retainer channel 402. This configuration of the retainer channel 402 corresponds to a partially closed channel at the top portion 404 while maintaining a narrow opening (i.e. the gap 418) therebetween (as shown in FIG. 4E). The retainer channel 402 may be integrally configured with the first and second flexible retainer members 412*a*, and 412*b* using casting and molding techniques.

Figure 4F:
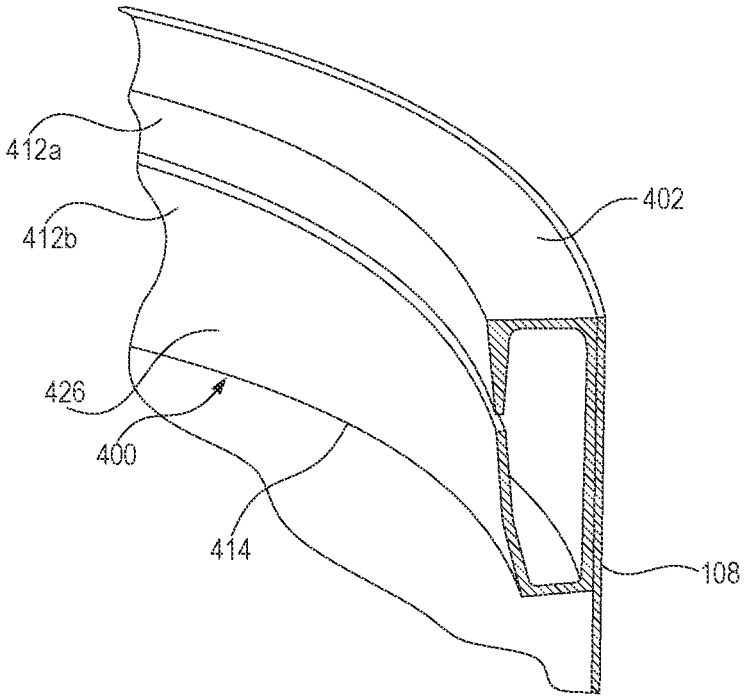
FIG. 4F illustrates a sectional view of a portion of the apparatus of FIG. 4A for retaining the mouth portion of the trash liner, in accordance with another embodiment of the present disclosure.

In another embodiment, the first and second flexible retainer members 412*a*, and 412*b* are configured along a length of an outer surface 426 of the sidewall 414 oriented towards the interior of the support structure 108 (as shown in FIG. 4F). It is to be noted that the pair of flexible retainer members 410 configured on the outer surface 426 of the sidewall 414 is perpendicular to the longitudinal axis A-A' of the trash receptacle 108.

Figure 5A:
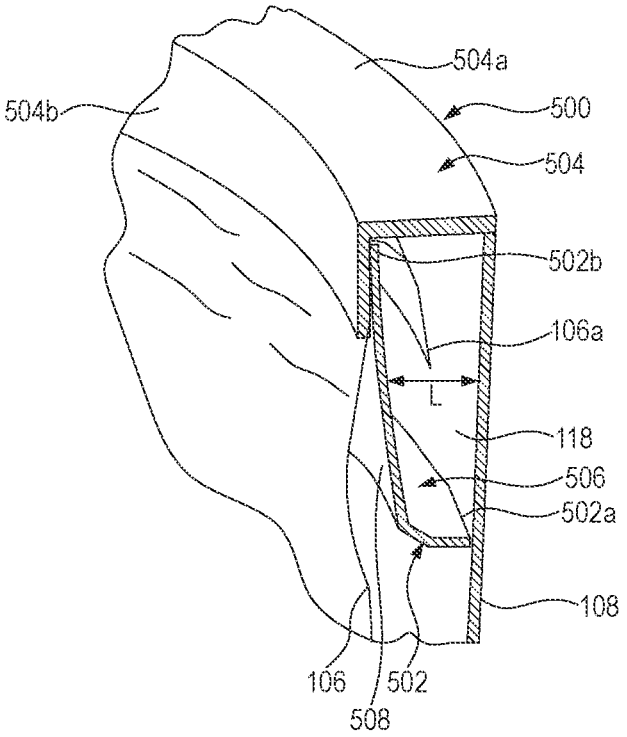
FIGS. 5A and 5B illustrate a sectional view of an apparatus for securing the mouth portion of the trash liner, in accordance with an embodiment of the present disclosure.

FIG. 5A illustrates a sectional view of a portion of an apparatus 500 for securing the mouth portion 106*a* of the trash liner 106, in accordance with another embodiment of the present disclosure. The apparatus 500 includes a retainer channel 502 and a retainer member 504. As shown, the retainer channel 502 is configured with a J-shaped configuration or an L-shaped configuration. The retainer channel 502 may be made of materials similar to the materials of the retainer channel 102 of FIG. 1A.

The retainer channel 502 includes a first end 502*a* and a second end 502*b*. In an embodiment, the first end 502*a* may be detachably mounted to the interior surface 118 of the trash receptacle 108 such that the second end 502*b* is positioned at the same height as the top end of the trash receptacle 108. Further, at least the portion of the interior surface 118 proximate to the aperture and the retainer channel 502 (J-shaped configuration) forms a passageway 506 therebetween. The passageway 506 is configured for receiving the mouth portion 106*a* of the trash liner 106 therein. In another embodiment, the first end 502*a* of the retainer channel 502 may be secured to the trash receptacle 108 using conventional means such as casting and molding techniques.

The retainer member 504 includes a first portion 504*a* and a second portion 504*b*. The first portion 504*a* may be configured based on the dimensions of a length (represented by 'L') of the passageway 506 in a horizontal direction, thereby ensuring a snug fit of the retainer member 504 to the retainer channel 502. Further, the second portion 504*b* corresponds to a flange member. As shown, the retainer member 504 is configured to include one flange member, and further the retainer member 504 may include more than one flange member (e.g., two flange members as shown in FIG. 1A) therefore, it should not be taken to limit the scope of the present disclosure. In use, the mouth portion 106*a* of the trash liner 106 is secured within the passageway 506. Thereafter, the retainer member 504 is secured to the retainer channel 502 by abutting the second portion 504*b* to at least a portion of the trash liner 106 overlapping on a portion of an outer surface 508 of the retainer channel 502 (as shown in FIG. 5A).

Figure 5B:
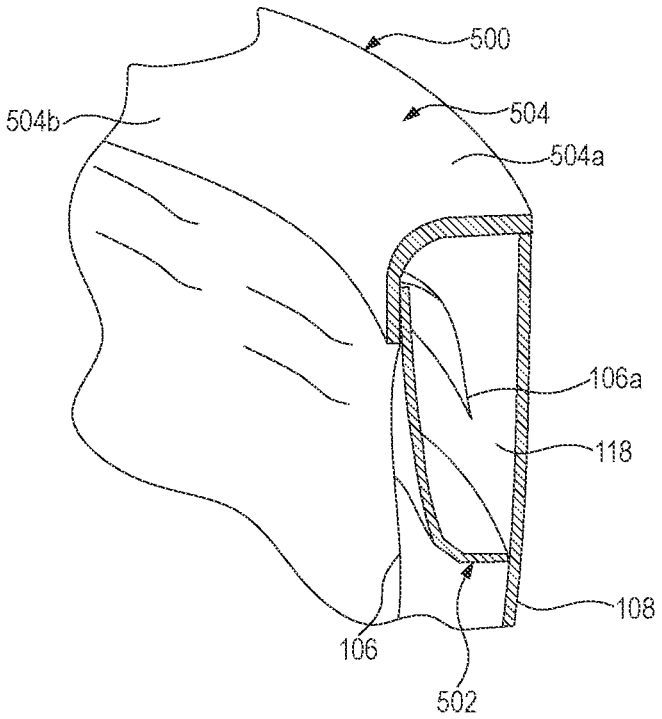

In an embodiment, the retainer member 504 may be configured with a curved profile (as shown in FIG. 5B). Specifically, the first portion 504*a* and the second portion 504*b* may be integrally formed with a curved profile based on the dimensions of the length 'L' of the passageway 506, thus ensuring a snug fit of the retainer member 504 to the retainer channel 502 (as shown in FIG. 5B). Further, the operability of the retainer member 504 configured with the curved profile (as shown in FIG. 5B) is similar to the operability of the retainer member 504 configured with vertical and horizontal planes, and a corner (as shown in FIG. 5A).

Figure 6:
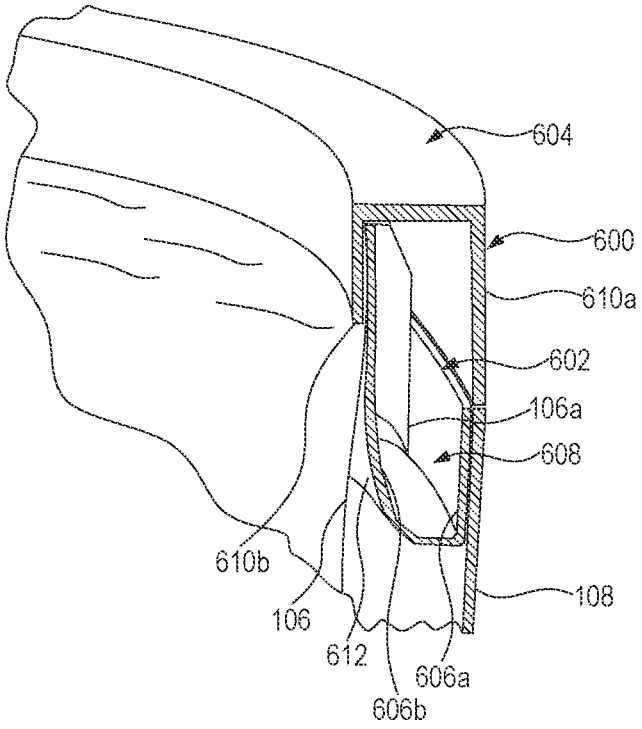
FIG. 6 illustrates a sectional view of an apparatus for securing the mouth portion of the trash liner, in accordance with an embodiment of the present disclosure.

FIG. 6 illustrates a sectional view of a portion of an apparatus 600 for securing the mouth portion 106*a* of the trash liner 106, in accordance with another embodiment of the present disclosure. The apparatus 600 includes a retainer channel 602 and a retainer member 604.

The retainer channel 602 is configured with a U-shaped configuration. Particularly, the retainer channel 602 includes a pair of sidewalls (i.e. a sidewall 606*a* and a sidewall 606*b*). The sidewalls 606*a* and 606*b* are configured with unequal length dimensions. As shown in FIG. 6, the length dimension of the sidewall 606*a* is relatively less than the length dimension of the sidewall 606*b*. In other words, the side walls 606*a* and 606*b* are configured with unequal length dimensions. Further, the retainer channel 602 is mounted to the interior surface 118 proximate to the aperture of the trash receptacle 108 such that the top end of the sidewall 606*a* and the trash receptacle 108 is maintained at the same height and the sidewall 606*b* exceeds the length of the trash receptacle 108 (as shown in FIG. 6). Further, the sidewalls 606*a* and 606*b* of the retainer channel 602 configured with the U-shaped configuration form a passageway 608 in the retainer channel 602. The mouth portion 106*a* of the trash liner 106 is disposed in the passageway 608.

The retainer member 604 may be configured based on the dimensions of the retainer channel 602. In an example, the retainer member 604 is configured with an inverted U-shaped structure. Particularly, the retainer member 604 includes one or more flange members (collectively referred for a flange member 610*a* and a flange member 610*b*). As shown, the length dimension of the flange member 610*a* is greater than the length dimension of the flange member 610*b*. In other words, the flange members 610*a* and 610*b* are configured with unequal length dimensions. It is to be noted that the length dimension of the flange member 610*a* is configured based on the length dimension of the portion of the sidewall 606*b* exceeding the length of the trash receptacle 108. In use, the mouth portion 106*a* of the trash liner 106 is secured within the retainer channel 602. Thereafter, the retainer member 604 is secured to the retainer channel 602 such that the flange member 610*b* abuts at least a portion of the trash liner 106 overlapping on a portion of an outer surface 612 of the retainer channel 602 (as shown in FIG. 6).

In an embodiment, the lower end of the flange member 610*a* may include securing means such as, but not limited to, adhesive or any other securing means for securing onto the top end of the trash receptacle 108.

Various embodiments of the disclosure, as discussed above, may be practiced with steps and/or operations in a different order, and/or with hardware elements in configurations, which are different than those which are disclosed. Therefore, although the disclosure has been described based upon these exemplary embodiments, it is noted that certain modifications, variations, and alternative constructions may be apparent and well within the scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. An apparatus for securing a trash liner, the apparatus comprising:

a retainer channel disposed on at least a portion of an interior surface proximate to an aperture of a support structure, the retainer channel comprising an inner surface defining an interior space within the retainer channel for receiving a mouth portion of the trash liner therein; and a retainer member comprising one or more flange members, each flange member of the one or more flange members extending from a bottom portion of the retainer member and oriented along a longitudinal axis of the support structure, wherein the retainer member is configured to removably secure to the retainer channel for retaining the mouth portion of the trash liner therebetween, while an unsecured portion of the trash liner is disposed within the support structure, and wherein the one or more flange members of the retainer member abuts the inner surface of the retainer channel for removably securing the retainer member to a top portion of the retainer channel.

2. The apparatus as claimed in claim 1, wherein the retainer member is configured based on a geometric design of the retainer channel for enabling a snug fit between the retainer member and the retainer channel.

3. The apparatus as claimed in claim 1, wherein the retainer channel is a U-shaped structure.

4. The apparatus as claimed in claim 1, further comprising:

a pair of flexible retainer members including a first flexible retainer member and a second flexible retainer member, the first and second flexible retainer members mounted to the inner surface of each sidewall of the retainer channel such that a portion of the first and second flexible retainer members is oriented parallel to a base surface of the retainer channel, wherein a free end of the first and second flexible retainer members is facing toward each other and positioned in close proximity, thus defining a gap therebetween.

5. The apparatus as claimed in claim 4, wherein at least one of the first flexible retainer member and the second flexible retainer member is operated in a collapsed form to alter the gap defined by the first and second flexible retainer members, thereby allowing insertion of the mouth portion of the trash liner within the interior space of the retainer channel.

6. The apparatus as claimed in claim 5, wherein the mouth portion is secured in the interior space of the retainer channel when at least one of the first and second flexible retainer members attain a retracted form from the collapsed form.

7. The apparatus as claimed in claim 1, wherein the retainer member is partitioned into two symmetrical segments, wherein each segment of the retainer member is mounted to the retainer channel via a hinge mechanism, and wherein each segment of the retainer member is operable between an open position and a closed position for retaining the mouth portion of the trash liner within the retainer channel.

8. The apparatus as claimed in claim 1, wherein the support structure is a trash receptacle.

9. The apparatus as claimed in claim 1, wherein the retainer member includes a lid fitted to one end of a top portion of the retainer member, and wherein the lid is operable between an open position and closed position for covering the aperture of the support structure.

10. The apparatus as claimed in claim 1, wherein the support structure comprises a plurality of elongated tubular structures, and wherein the retainer channel is supported on the plurality of elongated tubular structures such that the unsecured portion of the trash liner is allowed to flex in a space between the plurality of elongated tubular structures supporting the retainer channel.

11. The apparatus as claimed in claim 1, wherein a bottom portion of the retainer channel includes a plurality of slots configured at regular intervals, wherein each slot of the plurality of slots allows insertion of one end of an elongated tubular structure of the plurality of elongated tubular structures therein, and wherein the plurality of elongated tubular structures is oriented along a vertical direction upon securing the plurality of slots for supporting the retainer channel.

12. The apparatus as claimed in claim 1, wherein the retainer channel, the retainer member, and the support structure are configured in a shape comprising at least one of: oval, square, hexagon, rectangular, rectangular with rounded corners, and pentagon.

13. An apparatus for securing a mouth portion of a trash liner, the apparatus comprising:

a retainer channel disposed on at least a portion of an interior surface proximate to an aperture of a support structure, the retainer channel comprising an inner surface defining an interior space within the retainer channel for receiving a mouth portion of the trash liner therein; and a pair of flexible retainer members including a first flexible retainer member and a second flexible retainer member, the first and second flexible retainer members mounted to the inner surface of each sidewall of a pair of sidewalls of the retainer channel such that a portion of the first and second flexible retainer members is oriented parallel to a base surface of the retainer channel, wherein a free end of the first and second flexible retainer members is facing toward each other and positioned in close proximity, thus defining a gap therebetween, and wherein the first and second flexible retainer members are operated between a collapsed form and a retracted form for retaining the mouth portion of the trash liner within the interior space of the retainer channel.

14. The apparatus as claimed in claim 13, wherein operating at least one of the first and second flexible retainer members in the collapsed form alters the gap defined by the first and second flexible retainer members, thereby allowing insertion of the mouth portion of the trash liner within the interior space of the retainer channel.

15. The apparatus as claimed in claim 14, wherein the mouth portion of the trash liner is secured within the interior space of the retainer channel when at least one of the first and second flexible retainer members attains the retracted form from the collapsed form, and wherein an unsecured portion of the trash liner is disposed within the support structure upon securing the mouth portion of the trash liner within the retainer channel.

16. The apparatus as claimed in claim 13, wherein the pair of flexible retainer members is configured along a length of an outer surface of a sidewall of the retainer channel oriented towards the interior of the support structure.

17. The apparatus as claimed in claim 13, wherein the support structure comprises a plurality of elongated tubular structures, and wherein the retainer channel is supported on the plurality of elongated tubular structures such that an unsecured portion of the trash liner is allowed to flex in a space between the plurality of elongated tubular structures supporting the retainer channel.

18. The apparatus as claimed in claim 17, wherein a bottom portion of the retainer channel includes a plurality of slots at regular intervals, wherein each slot of the plurality of slots allows insertion of one end of an elongated tubular structure of the plurality of elongated tubular structures therein, and wherein the plurality of elongated tubular structures is oriented along a vertical direction upon securing to the plurality of slots for supporting the retainer channel.

19. The apparatus as claimed in claim 13, wherein the retainer channel is configured with a J-shaped configuration.

20. The apparatus as claimed in claim 13, wherein each sidewall of the pair of sidewalls of the retainer channel and each flange member of the one or more flange members of the retainer member are configured with unequal length dimensions.

21. An apparatus for securing a mouth portion of a trash liner, the apparatus comprising:

a retainer channel disposed on at least a portion of an interior surface proximate to an aperture of a support structure, the retainer channel comprising an inner surface defining an interior space within the retainer channel for receiving the mouth portion of the trash liner therein; and a retainer member comprising one or more flange members, each flange member of the one or more flange members extending from a bottom portion of the retainer member and oriented along a longitudinal axis of the support structure, wherein the retainer member is configured based on a geometric design of the retainer channel for enabling a snug fit between the retainer member and the retainer channel, wherein the retainer member is configured to removably secure to the retainer channel for retaining the mouth portion of the trash liner therebetween, while an unsecured portion of the trash liner is disposed within the support structure, and wherein the one or more flange members of the retainer member abuts the inner surface of the retainer channel for removably securing the retainer member to a top portion of the retainer channel.

22. The apparatus as claimed in claim 21, wherein a bottom portion of the retainer channel includes a plurality of slots at regular intervals, wherein each slot of the plurality of slots allows insertion of one end of an elongated tubular structure of the plurality of elongated tubular structures therein, and wherein the plurality of elongated tubular structures is oriented along a vertical direction upon securing to the plurality of slots for supporting the retainer channel.

23. The apparatus as claimed in claim 21, wherein the retainer member is configured with a curved profile.

* * * * *